US007182654B1

(12) United States Patent
Gracki et al.

(10) Patent No.: US 7,182,654 B1
(45) Date of Patent: Feb. 27, 2007

(54) METHOD AND APPARATUS FOR COUPLING A SHEATHED HEATER TO A POWER HARNESS

(75) Inventors: John Gracki, Louisville, KY (US); Kristian Michael Magnuson, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/219,269

(22) Filed: Sep. 2, 2005

(51) Int. Cl.
*H01R 11/22* (2006.01)

(52) U.S. Cl. ..... 439/851; 219/452.12

(58) Field of Classification Search ..... 439/851; 219/452.12
See application file for complete search history.

(56) References Cited

U.S. PATENT DOCUMENTS 4,742,324 A 5/1988 Shida et al.
4,829,158 A * 5/1989 Burnham ..... 219/400
4,950,873 A 8/1990 Shida et al.
5,176,533 A * 1/1993 Sakurai et al. ..... 439/352
5,198,641 A 3/1993 Nagano et al.
5,401,937 A 3/1995 Nagano et al.
5,449,861 A 9/1995 Fujino et al.
5,897,806 A 4/1999 Watanabe
6,710,305 B2 3/2004 Lindemann et al.

* cited by examiner

*Primary Examiner*—Truc Nguyen
(74) *Attorney, Agent, or Firm*—Armstrong Teasdale LLP

(57) ABSTRACT

A sheathed heater assembly includes a sheathed heating element and a cold pin electrically coupled to the sheathed heating element. The cold pin includes a free end including an electrical connector. The electrical connector is configured to mate with a mating connector to electrically connect the sheathed heating element to a wiring harness. The electrical connector has a circumferential groove and a longitudinal axis. The longitudinal axis of the electrical connector is coextensive with a longitudinal axis of the cold pin.

19 Claims, 4 Drawing Sheets

METHOD AND APPARATUS FOR COUPLING A SHEATHED HEATER TO A POWER HARNESS

BACKGROUND OF THE INVENTION

This invention relates generally to a sheathed heating element for an appliance, and more particularly, to a connector for coupling a sheathed heating element to a power harness.

Sheathed heating elements are commonly used as heating elements in electrical appliances, particularly electric ranges. In addition, sheathed heating elements also find application in such appliances as dishwashers and electric clothes dryers.

Sheathed heating elements typically include a tab welded to the sheathed heater for connecting the sheathed heater to a wiring harness. The wiring harness includes a female connector configured to mate with the tab to couple the sheathed heater to the wiring harness. The weld area between the tab and the sheathed heater has a small cross section and is an area of increased resistance to electrical current flow and also to conduction heat transfer. Consequently, the weld area may generally reduce the life of the sheathed heater-to-wiring harness couple. In addition, the tab is a high-volume component that increases the part count of the appliance containing the sheathed heater. With the use of the traditional tab connectors, the ability to control the surface area of the couple or to optimize the interference between the mating surfaces in the connection are substantially precluded.

BRIEF DESCRIPTION OF THE INVENTION

In one aspect, a sheathed heater assembly for an appliance is provided. The sheathed heater assembly includes a sheathed heating element and a cold pin electrically coupled to the sheathed heating element. The cold pin includes a free end including an electrical connector. The electrical connector is configured to mate with a mating connector to electrically connect the sheathed heating element to a wiring harness. The electrical connector has a circumferential groove and a longitudinal axis. The longitudinal axis of the electrical connector is coextensive with a longitudinal axis of the cold pin.

In another aspect, a connector assembly for electrically coupling a sheathed heater assembly to a wiring harness is provided. The connector assembly includes a pin connector formed on an end of the sheathed heater assembly such that the pin connector and the end of the sheathed heater assembly have a common centerline. The pin connector includes a circumferential groove. A receptacle connector has a mating end and a wire receiving end. The wire receiving end is configured to be joined to a wiring harness conductor. The pin connector is configured to mate with the receptacle connector.

In yet another aspect, a method for coupling a sheathed heater assembly to a wiring harness is provided. The method includes providing a sheathed heating element, joining a cold pin to the sheathed heating element such that the cold pin has a free end, forming a pin connector on the free end of the cold pin, forming a receptacle connector having a substantially cylindrical mating end sized to receive the pin connector, attaching the receptacle connector to a wiring harness, and mating the pin connector with the receptacle connector.

DETAILED DESCRIPTION OF THE INVENTION

Figure 1:
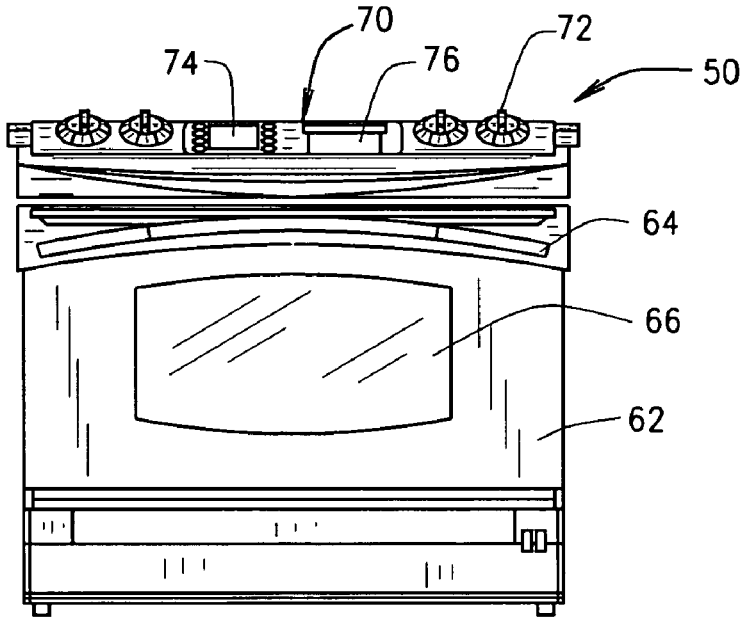
FIG. 1 is a front view of an electric range.
Figure 2:
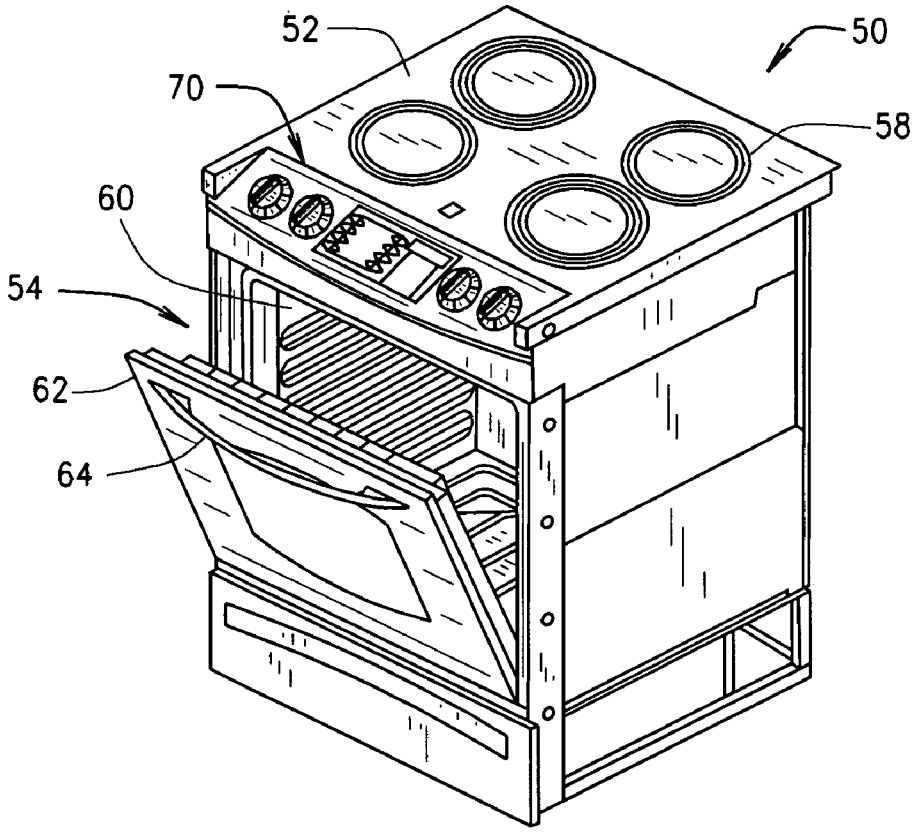
FIG. 2 is a perspective view of the range shown in FIG. 1.

FIG. 1 is a front view of an electric range 50 speedcook oven including a cooktop 52 and an oven 54. FIG. 2 is a perspective view of electric range 50. Cooktop 52 includes a plurality of heating elements 58 for cooking food on cooktop 52. Oven 54 includes an oven cooking cavity 60. An oven door 62 is provided that has a handle 64 secured thereto. Oven door 62 includes a window 66 provided for viewing food in oven cooking cavity 60. Range 50 also includes a control panel 70. A dial 72 for each heating element 58 is provided on control panel 70 to regulate a heat output of a respective heating element 58. Control panel 70 also includes at least one display 74, and a plurality of other controls and dials that may include tactile control buttons 76.

Although the invention will be described with reference to an electric oven, it is to be understood that no limitation is intended thereby, and the benefit hereinafter described may be applicable to other types of electric appliances, including, but not limited to, dishwashers, clothes dryers, toaster ovens, and other appliances having heating elements. Further, the invention may be used in combination with ranges and ovens other than the particular range described above.

Figure 3:
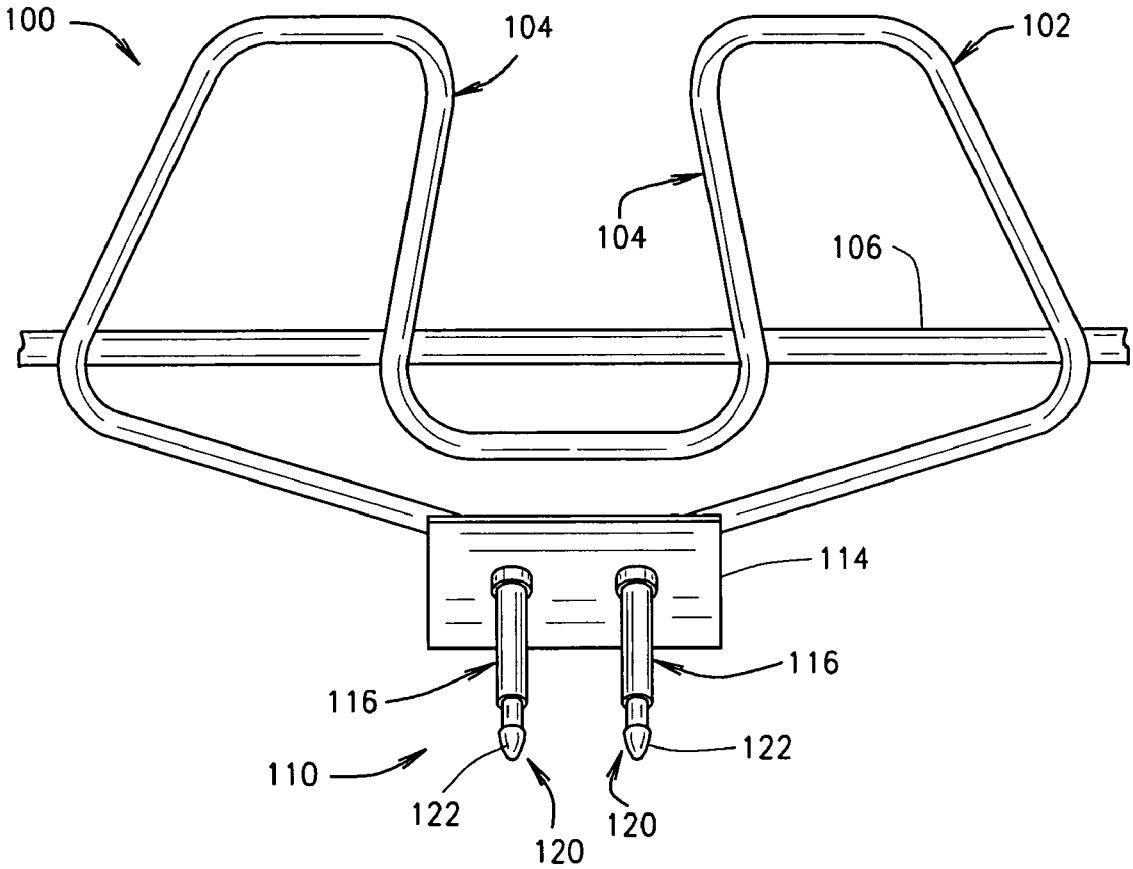
FIG. 3 is a perspective view of an exemplary sheathed heater.
Figure 4:
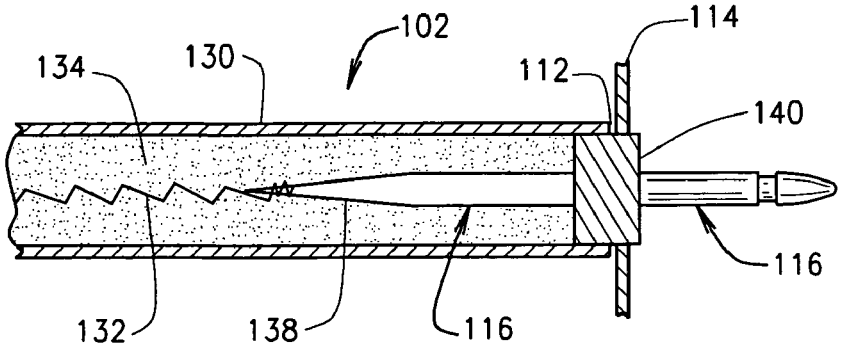
FIG. 4 is a cross sectional view of a portion of the sheathed heater shown in FIG. 3.

FIG. 3 is a perspective view of an exemplary sheathed heater assembly 100 that is suitable for use in oven 54 of range 50. FIG. 4 is a cross sectional view of a portion of the sheathed heater assembly 100. Sheathed heater assembly 100 is a resistance heater that includes a sheathed heating element 102 formed with multiple bends or loops 104 which facilitates fitting the sheathed heater assembly 100 in oven cooking cavity 60. In the illustrated embodiment, two major loops 104 are formed. A brace 106 is attached to sheathed heating element 102 in such a manner that brace 106 spans loops 104. Brace 106 also acts as a standoff to support sheathed heating element 102 off of a floor (not shown) of oven cooking cavity 60.

Sheathed heater assembly 100 includes a mating end 110 that is configured to be mated to a wiring harness (not shown) that provides power to sheathed heater assembly 100. Sheathed heating element 102 is a continuous member having first and second ends 112 that are both coupled to a bracket 114 proximate mating end 110. A cold pin 116 is coupled to each end 112 of sheathed heating element 102. Each cold pin 116 has an end 120 that is formed as a connector 122.

Sheathed heating element 102 includes a tubular outer sheath 130 that houses a helical resistance wire 132. In an exemplary embodiment, outer sheath 130 is fabricated from a metal such as inconel or stainless steel. The interior of outer sheath 130 is filled with a packing material 134 such as magnesium oxide to isolate helical resistance wire 132 from outer sheath 130. Cold pin 116 extends into outer sheath 130 and is joined to helical resistance wire 132. Cold pin 116 is joined to helical resistance wire 132 by known methods such as spot welding or tig welding. In some embodiments, cold pin 116 is formed with a lead-in portion 138 for ease of assembly. A stopper or plug 140 is provided to close ends 112 of outer sheath 130 to inhibit the entry of moisture into the interior of outer sheath 130.

Figure 5:
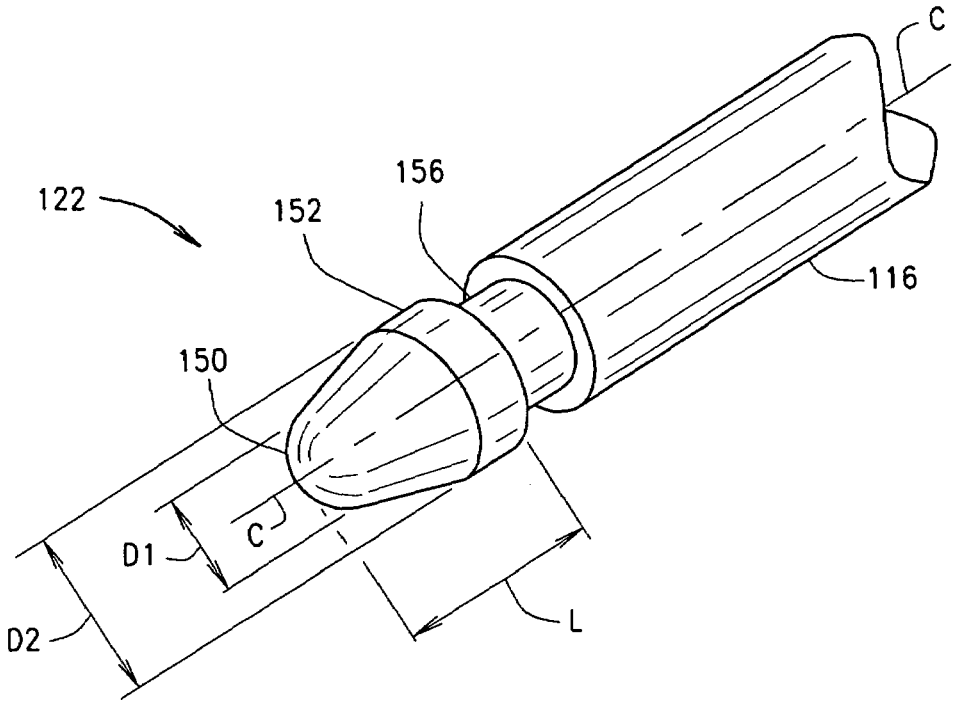
FIG. 5 is a perspective view of a male electrical connector for a sheathed heater.

FIG. 5 is a perspective view of connector 122 which is formed on the end of cold pin 116. Connector 122 is in the form of a male pin type connector. Connector 122 is generally bullet shaped and may be formed using a stamping or pressing process such that connector 122 and cold pin 116 have a common centerline C. In an exemplary embodiment, connector 122 is unitarily formed with cold pin 116. Connector 122 includes a tip 150 that may exhibit a spherical or conical profile or a combination thereof. Connector 122 has a generally circular cross section and has a tip diameter $D_1$. Connector 122 tapers from tip 150 to a generally cylindrical rearward portion 152 having a diameter $D_2$ that is greater than tip diameter $D_1$. A groove 156 is formed rearward of and adjacent to rearward portion 152. Connector 122 has an engagement length L that extends from tip 150 to groove 156.

Figure 6:
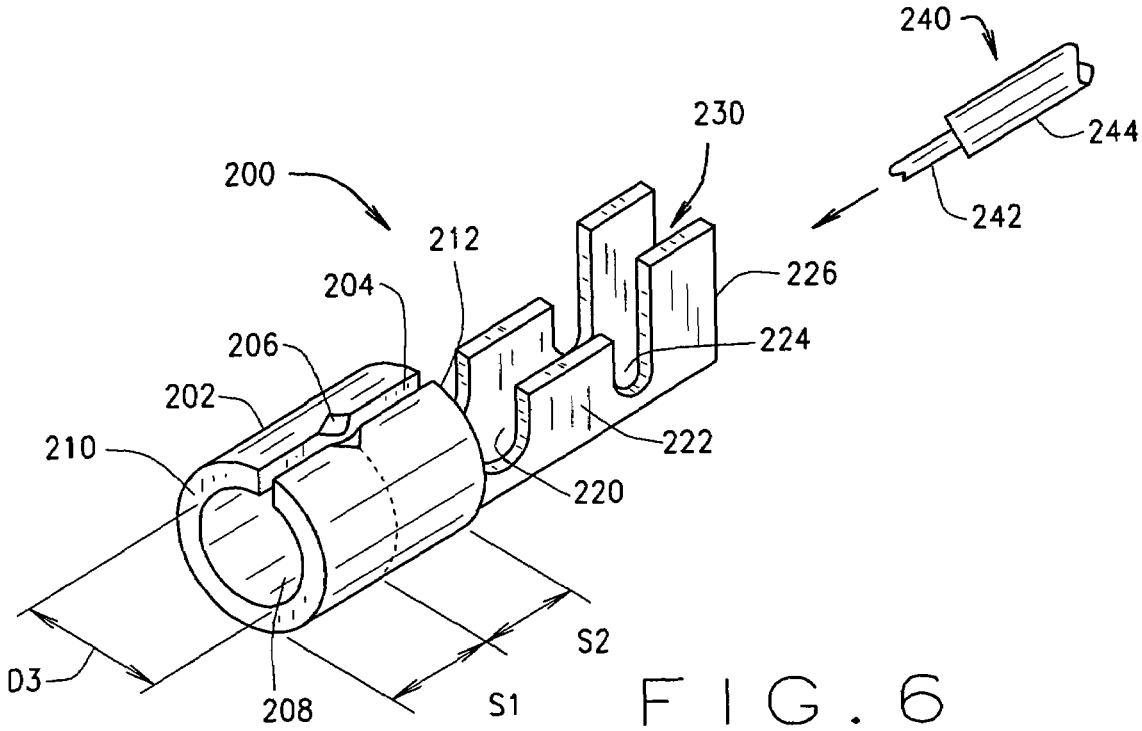
FIG. 6 is a perspective view of a female electrical connector for a wiring harness.

FIG. 6 is a perspective view of a female electrical connector 200. Connector 200 may be electrically connected to a wiring harness (not shown). Female connector 200 is configured to be mated with connector 122 to provide power to sheathed heater assembly 100. Connector 200 includes a generally cylindrical body 202 that has an internal diameter $D_3$. Body 202 is formed with a longitudinally extending seam or slit 204 that allows body 202 to expand while being mated and unmated with connector 122. Body 202 also includes a dimple 206 formed at seam 204. A portion of dimple 206 extends into an interior 208 of body 202. Body 202 defines a first distance $S_1$ extending from a forward end 210 to dimple 206 and a second distance $S_2$ from dimple 206 to a rearward end 212. Connector 200 includes a wire barrel 220, wire crimp tabs 222, an insulation barrel 224 and insulation crimp tabs 226.

Connector 200 includes a wire receiving end 230 that receives an insulated cable 240 from a wiring harness (not shown). A portion of the insulation is removed to expose a length of bare wire or conductor 242 which is placed in wire barrel 220 and crimped to connector 200 using wire crimp tabs 222. An insulated portion 244 of cable 240 is place in insulation barrel 224 and is crimped to connector 200 using insulation crimp tabs 226. In this manner, cable 240 is secured to connector 200 to provide an electrical connection.

Dimple 206 is configured to be received in groove 156 on connector 122 when connector 122 is mated with connector 200 to retain connector 122 within connector 200. Additionally, the extension of dimple 206 into interior 208 may be established so as to provide a desired separation force to separate connector 122 from connector 200. Connectors 122 and 200 are formed such that distance $S_2$ on connector 200 at least slightly exceeds engagement length L on connector 122 so that dimple 206 may be received in groove 156. Further, diameter $D_2$ of connector 122 and inner diameter $D_3$ of connector 200 are sized to provide a desired push force to join connectors 122 and 200.

When connectors 122 and 200 are joined, an interface is formed that has an interface area defined by the total area of mutual contact between the surfaces on conductors 122 and 200. The engaged lengths together with respective diameters of connectors 122 and 200 may be established to yield an interface area that facilitates reducing electrical at the interface and minimizing hot spots at the interface.

Figure 7:
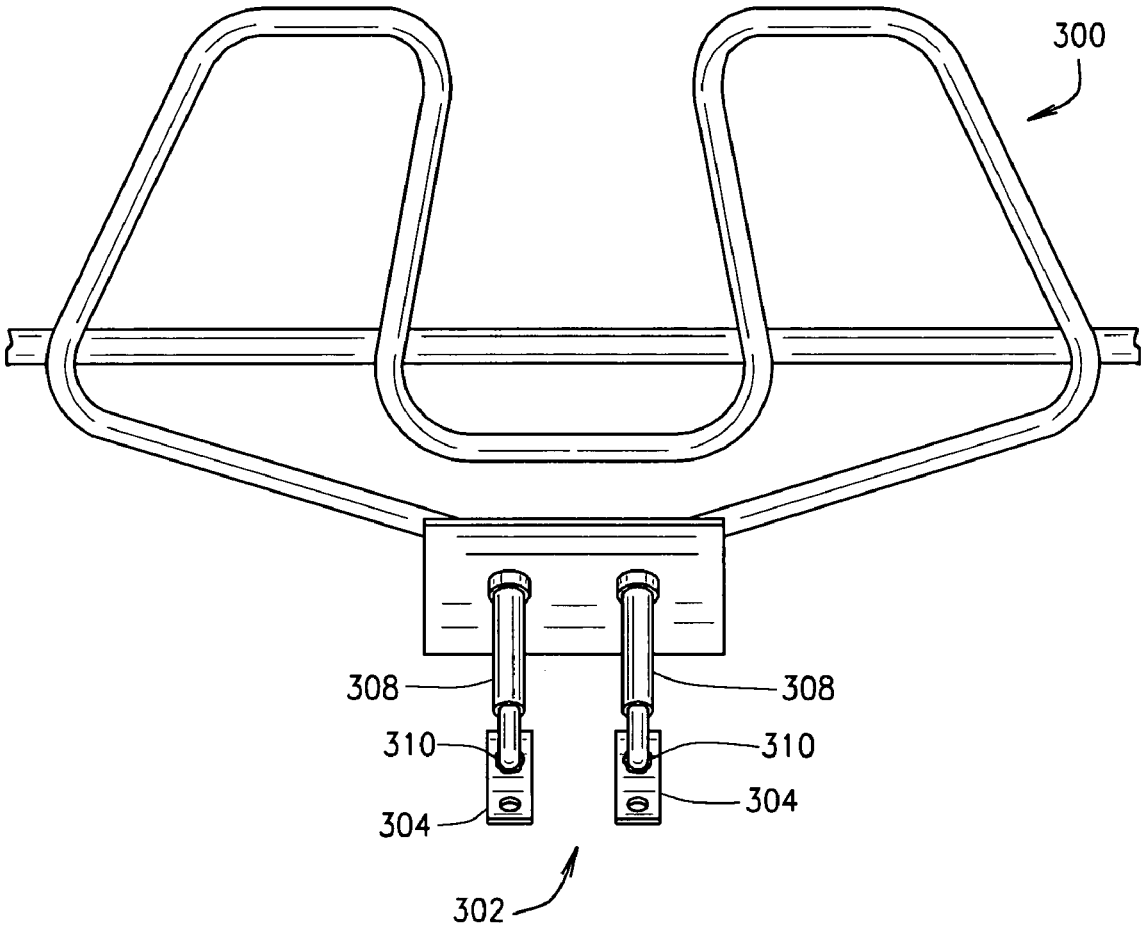
FIG. 7 PRIOR ART
FIG. 7 is a perspective view of a prior art sheathed heater.

FIG. 7 is a perspective view of a known sheathed heater 300. Sheathed heater 300 includes an electrical interface 302 including tabs 304 that are welded to cold pins 308. Weld areas 310 define an interface between tabs 304 and cold pins 308 that presents a relatively small interface area that may be susceptible to failures and that present a discontinuity to conduction heat transfer. The interface area thus formed is an area of relatively high electrical resistance and an obstruction to heat flow that results in the formation of hot spots. Cost reduction opportunities may be realized from the elimination of tabs 304 and the welding operation to attach tabs 304 to cold pins 308.

The embodiments thus described provide a coupling method for sheathed heater assemblies that reduce manufacturing costs by eliminating the connector tabs and the welding operation to attach the tabs to the cold pins of the sheathed heater assembly. Additionally, the design of the male pin or bullet type connector and the female socket connector provide an opportunity to control connector engagement and disengagement forces and contact surface areas to reduce resistance and hot spots. Though described with respect to a sheathed heater assembly for an oven, the benefits of the invention are also applicable to broiler elements as well as cooktop heating elements.

While the invention has been described in terms of various specific embodiments, those skilled in the art will recognize that the invention can be practiced with modification within the spirit and scope of the claims.

What is claimed is:

1. A sheathed heater assembly for an appliance, said sheathed heater assembly comprising:

a sheathed heating element; and a cold pin electrically coupled to said sheathed heating element, said cold pin including a free end comprising an electrical connector configured to mate with a mating connector to electrically connect the sheathed heating element to a wiring harness, said electrical connector having a circumferential groove and a longitudinal axis, said electrical connector longitudinal axis coextensive with a central longitudinal axis of said cold pin, said electrical connector comprising an endmost tip portion positioned alone said electrical connector longitudinal axis.

2. A sheathed heater in accordance with claim 1 wherein said electrical connector is unitarily formed with said cold pin.

3. A sheathed heater in accordance with claim 1 wherein said electrical connector has a circular cross section and includes a tapered mating end.

4. A sheathed heater in accordance with claim 3 wherein said circumferential groove is positioned between said tapered mating end and said cold pin.

5. A connector assembly for electrically coupling a sheathed heater assembly to a wiring harness, said connector assembly comprising:

a pin connector formed on an end of the sheathed heater assembly such that said pin connector and the end of the sheathed heater assembly have a common centerline, said pin connector including a circumferential groove, and an endmost tip portion positioned along the common centerline; and a receptacle connector having a mating end and a wire receiving end, said wire receiving end configured to be joined to a wiring harness conductor, said pin connector configured to mate with said receptacle connector.

6. A connector assembly in accordance with claim 5 wherein said sheathed heater assembly includes a cold pin, said pin connector unitarily formed with said cold pin.

7. A connector assembly in accordance with claim 5 wherein said pin connector includes a tapered mating end.

8. A connector assembly in accordance with claim 7 wherein said sheathed heater assembly includes a cold pin, said circumferential groove positioned between said tapered mating end and said cold pin.

9. A connector assembly in accordance with claim 5 wherein said mating end of said receptacle connector includes a substantially cylindrical hollow body defining an interior therein, said body having a longitudinally extending seam and a dimple formed at said seam, said dimple extending toward said interior of said body.

10. A connector assembly in accordance with claim 9 wherein said dimple configured to engage said groove on said pin connector.

11. A connector assembly in accordance with claim 9 wherein said dimple configured to provide a desired separating force required to separate said pin connector from said receptacle connector when said pin connector is mated with said receptacle connector.

12. A connector assembly in accordance with claim 5 wherein said receptacle connector includes a wire barrel and an insulation barrel for coupling said receptacle to an insulated conductor.

13. A method for coupling a sheathed heater assembly to a wiring harness comprising:

providing a sheathed heating element;

joining a cold pin to the sheathed heating element such that the cold pin has a free end;

forming a pin connector on the free end of the cold pin, the pin connector defining a circumferential groove and having an endmost tip portion positioned along a central longitudinal axis of the pin connector;

forming a receptacle connector having a substantially cylindrical mating end sized to receive the pin connector;

attaching the receptacle connector to a wiring harness; and mating the pin connector with the receptacle connector.

14. A method in accordance with claim 13 wherein forming the pin connector comprises unitarily forming the pin connector with the cold pin.

15. A method in accordance with claim 13 wherein forming the pin connector comprises forming the pin connector using a stamping process.

16. A method in accordance with claim 13 wherein forming the receptacle connector comprises forming the receptacle connector from a flat tab.

17. A method in accordance with claim 16 wherein forming the receptacle connector from a flat tab comprises forming the receptacle connector with a seam.

18. A method in accordance with claim 17 wherein forming the receptacle connector with a seam further comprises forming the receptacle connector with a dimple at the seam.

19. A method in accordance with claim 13 wherein attaching the receptacle to a wiring harness comprises crimping the receptacle to a conductor in the wiring harness.

* * * * *

UNITED STATES PATENT AND TRADEMARK OFFICE

CERTIFICATE OF CORRECTION

PATENT NO. : 7,182,654 B1
APPLICATION NO. : 11/219269
DATED : February 27, 2007
INVENTOR(S) : Gracki et al.

It is certified that error appears in the above-identified patent and that said Letters Patent is hereby corrected as shown below:

Column 4, line 44, delete “alone” and insert therefor -- along --.

Signed and Sealed this

Twenty-fourth Day of June, 2008

JON W. DUDAS
*Director of the United States Patent and Trademark Office*